United States Patent [19]

Hanisch et al.

[11] 4,120,726

[45] Oct. 17, 1978

[54] SILVER-HALIDE EMULSION SENSITIZED WITH AN ASYMMETRICAL DISULFIDE

[75] Inventors: Gerhard Hanisch, Dessau; Günther Fischer, Leipzig; Seigfried Gahler, Wolfen; Udo Franz, Dessau; Karl Küschel, Mühlbeck; Roland Mayer, Dresden; Günther Bach; Karl-Wilhelm Jünge, both of Dessau, all of German Democratic Rep.

[73] Assignee: VEB Filmfabrik Wolfen, German Democratic Rep.

[21] Appl. No.: 824,188

[22] Filed: Aug. 12, 1977

Related U.S. Application Data

[63] Continuation of Ser. No. 676,592, Apr. 13, 1976, abandoned.

[30] Foreign Application Priority Data

Apr. 15, 1975 [DD] German Democratic Rep. ..... 038542

[51] Int. Cl.[2] ..... G03C 1/28

[52] U.S. Cl. ..... 96/107; 96/108

[58] Field of Search ..... 96/107, 108, 109

[56] References Cited

U.S. PATENT DOCUMENTS

| | | | |
|---|---|---|---|
| 2,438,716 | 3/1948 | Mueller | 96/109 |
| 3,043,696 | 7/1962 | Herz et al. | 96/109 |
| 3,057,725 | 10/1962 | Herz et al. | 96/109 |
| 3,226,232 | 12/1965 | Dersch et al. | 96/107 |
| 3,728,126 | 4/1973 | Pollet et al. | 96/107 |

*Primary Examiner*—Won H. Louie, Jr.
*Attorney, Agent, or Firm*—Nolte & Nolte

[57] ABSTRACT

An improved photographic silver-halide emulsion containing a sensitizer additive which is an asymmetrical disulfide of the formula $$(W)_a(X)_bA—S—S—B(Y)_c(Z)_d$$

wherein:

A and B are each aryl, alkyl or aralkyl radicals,
X and Y are each carboxyl or alkoxycarbonyl groups,
W and Z are each amino groups which may be alkylated or acylated,
*a, b, c, d* are each 0 to 3 and
$a + d \geqq 1$ and $b + c \geqq 1$.

20 Claims, No Drawings

SILVER-HALIDE EMULSION SENSITIZED WITH AN ASYMMETRICAL DISULFIDE

This is a continuation of application Ser. No. 676,592 filed Apr. 13, 1976, now abandoned.

BACKGROUND OF THE INVENTION

1. Field of the Invention

This invention relates to a photographic silver-halide emulsion. More particularly, this invention relates to a sensitizing agent for use in a photographic silver-halide emulsion which improves the sensitivity of the photographic halide emulsion while decreasing intensity of the same to develop a veil or fog following sensitization or during storage.

2. Discussion of the Prior Art

It is known, in order to improve the chemical development of a photographic film or plate, to add to the photographic emulsion a sulfur containing sensitizer such as, for example, a symmetrical disulfide, a cysteine, a cystine or an N-substitive product thereof. Reduction agents or gold compounds or combinations thereof have also been used as sensitizers. The use of these materials increases the sensitivity of the photographic emulsion during the digestion or ripening process. However, for many purposes, the attained sensitivity increase is inadequate or is afflicted with the disadvantage of a strong tendency toward fogging. The resultant veil or fog form can sometimes occur only following the spectral sensitization or during storage.

It has therefore become desirable to provide a photographic silver-halide emulsion which possessess a high sensitivity. More specially, it has become desirable to provide such a photographic silver-halide emulsion which has a marked reduced tendency toward fog formation. Accordingly, it is an object of the present invention to provide an improved photographic silver-halide emulsion characterized by high sensitivity and reduced tendency to fog formation. It is a special object of the present invention to provide a photographic emulsion having increased sensitivity and gradation.

SUMMARY OF THE INVENTION

According to the present invention, there is provided a silver-halide photographic emulsion comprising a silver-halide and an asymmetrical disulfide of the formula $$(W)_a(X)_bA\text{-}S\text{-}S\text{-}B(Y)_c(Z)_d$$

wherein:

A and B are independently aryl, alkyl or aralkyl radicals;

X and Y are independent carboxyl or alkoxycarbonyl groups;

W and Z are independently amino groups which amino groups can be alkylated or acylated;

a, b, c and d are each independently 0 to 3 and $a + d \geqq 1$ and $b + c \geqq 1$.

Particularly contemplated compounds of the asymmetrical disulfides include the following:

1. $H_2N—CH_2—CH_2—S—S—CH_2—COOH$
2. $H_3C—S—S—CH_2—CH(NH_2)—COOH$
3. $i—C_3H_7—S—S—CH_2—CH(NH_2)—COOH$
4. $H_5C_6—CH_2—S—S—CH_2—CH(NH_2)—COOH$
5. $H_2N—CH_2—CH_2—S—S—CH_2—CH(NH_2)—COOH$

6. $n—C_3H_7—S—S—CH_2—CH(NH_2)—COOCH_3$
7. $n—C_3H_7—S—S—CH_2—CH(NHCH_3)—COOH$
8. $n—C_3H_7—S—S—CH_2—CH(NHCOCH_3)—COOH$

DISCUSSION OF SPECIFIC EMBODIMENTS

Of the compounds set forth, some of the compounds not only possess the desired sensitivity for short time exposure but also have a particularly good effectiveness during long exposure periods, at appropriately low intensity. It should be noted in this connection that those compounds where W and Z is an alkyl amino group, particularly an alkyl amino group, such as compound 7, that in addition to the desired sensitivity increase during the usual short exposure period they possess particularly good effectiveness during long exposure periods at the appropriately low intensity.

Generally speaking, the asymmetrical disulfides employed pursuant to the present invention are applicable in wide variety of silver-halide photographic emulsions. Generally speaking, the silver-halide emulsions are silver bromide emulsions of the known type. They are employed in an amount between $0.5 \times 10^{-5}$ to $2 \times 10^{-3}$ mol asymmetric disulfide per mol of silver-halide in the photographic emulsion. Photographic emulsions may also contain known noble metals or reduction sensitizers.

The silver-halide emulsion can contain the usual additive such as the binders. For this purpose, it is preferred that gelatin binders be employed (particularly inert gelatin binders) and/or gelatin substitutes. Of course, the binder can contain other additives such as the conventional antifog agents, sensitizers, spectral sensitizers and color coupling agents. These additional agents can be present in the amounts in which they are usually present in the photographic emulsion.

The sensitizing effect of the asymmetric disulfides, according to the invention, is illustrated by the examples set forth below.

EXAMPLE 1

A silver-bromide-chloride emulsion was produced with an inert gelatin binder. It was divided prior to chemical digestion into three parts and after the addition of various chemical sensitizers, as set forth below, was redigested, coated, exposed and developed. The three portions contained the chemical sensitizers and amounts set forth below, the amounts being expressed in terms of kgs. of emulsion.

Test A: no additions

Test B: 5 mg. sodiumthiosulphate per kg. emulsion

Test C: 8.5 mg. of $n—C_3H_7—S—S—CH_2—CH(NH_3)—COOCH_3$

The sensitivities and the extent of fog development were measured. Sensitivity at 0.1 or 1.0 indicates the relative sensitivity at a density of 0.1 to 1.0 above the fog. Differences of 1.0 indicate half or double sensitivity. The development lasted five minutes at 20° C. in a developing agent of the following composition:

1.5 g N-methyl-p-aminophenol-hydrogensulphate
18 g sodiumsulfite
2.5 g hydroquinone
18 g potassium carbonate
1 g potassium bromide per 1 liter dissolved in distilled water As shown in Table 1 below, sodiumthiosulphate which is the most generally employed sulphur-containing sensitizer causes under these conditions, in the absence of gold salts, an intense acceleration of the digestion process which, despite a reduction in the re-digestion temperature, quickly produces a fog, without an increase in sensitivity. On the other hand, the use of the asymmetrical disulfide produces a sensitivity increase in the threshold in the characteristic curve which is approximately double that provided by the sodiumthiosulphate sensitizer without causing an increase in fogging.

Table 1

| Sample | Digestion Temp. (° C.) | Digest. Time (min.) | Fog | Sensitivity (0.1) | Sensitivity (1.0) | Gradation |
|---|---|---|---|---|---|---|
| A | 58 | 30 | 0.28 | 6.5 | 5.0 | 3.6 |
| | | 60 | 0.44 | 7.3 | 6.2 | 4.2 |
| | | 90 | 0.65 | 7.1 | 6.0 | 4.3 |
| B | 50 | 30 | 0.28 | 7.0 | 6.2 | 5.1 |
| | | 60 | 0.70 | 7.3 | 6.1 | 4.0 |
| C | 58 | 30 | 0.32 | 7.3 | 6.2 | 3.7 |
| | | 60 | 0.44 | 8.0 | 6.7 | 3.8 |
| | | 90 | 0.57 | 8.3 | 7.0 | 4.0 |

EXAMPLE 2

A silver-bromide-chloride emulsion produced according to Example 1, was divided into 4 parts, prior to chemical digestion and compounded with various chemical sensitizers. The emulsions were re-digested under the same conditions and processed according to Example 1. The chemical sensitizers employed and their amounts were as follows:

Test A: only dirhodanoaurate (I) complex salt (corresponding to 2 mg gold) per kg of emulsion.

Test B: Same emulsion as Test A taking in addition 1 mg sodiumthiosulphate per kg of emulsion.

Test C: Same emulsion as Test A but containing 2 mg sodiumthiosulphate per kg of emulsion.

Test D: Same emulsion as Test A but containg in addition 20 mg of compound $H_3C—S—S—CH_2—CH(NH_2)—COOH$ per kg of emulsion.

Various emulsions were tested, as in Example 1 to determine the extent to which fog formation developed and to measure their sensitivities. The following results were obtained:

Table 2

| Sample | Fog | Sensitivity (0.1) | Sensitivity (0.1) | Gradation |
|---|---|---|---|---|
| A | 0.20 | 8.8 | 7.7 | 3.5 |
| B | 0.21 | 9.3 | 8.0 | 3.7 |
| C | 0.26 | 8.9 | 7.8 | 3.8 |
| D | 0.18 | 9.2 | 8.1 | 5.0 |

The values illustrate clearly, opposite to digestion effected only with gold salt, the sensitizing effect of the employed asymmetrical disulfide was quite good while it was characterized by a low tendency toward fogging. It is superior in terms of fog formation to the known photographic sensitizers by being characterized by a superior sensitivity. It is noticeably superior to the conventional sulfuric sensitizer sodium thiosulphate.

EXAMPLE 3

Another emulsion according to Example 1 was prepared and divided into eight parts, prior to chemical digestion, and processed according to Example 1. There were prepared eight separate photographic emulsions. The emulsions have the following additives present in the given amounts:

Test A: only the gold salt according to Example 2 in an amount corresponding to 2 mg of gold per kg of emulsion.

Test B: same as Test A but additionally containing 10 mg S-methylmercapto-L-cysteine per kg of emulsion.

Test C: same as Test A but additionally containing 25 mg S-methylmercapto-L-cysteine per kg of emulsion.

Test D: same as Test A but additionally containing 11.5 mg S-ethylmercapto-L-cysteine per kg of emulsion.

Test E: same as Test A but additionally containing 29 mg S-ethylmercapto-L-cysteine per kg of emulsion.

Test F: same as Test A but additionally containing 12.5 mg. S-n-propylmercapto-L-cysteine per kg of emulsion.

Test G: same as Test A but additionally containing 13.5 mg. S-n-butylmercapto-L-cysteine per kg. of emulsion.

Test H: same as Test A but additionally containing 15.5 mg. S-benzylmercapto-L-cysteine.

The respective emulsions were tested to determine their sensitivity levels and the extent to which they tended to form a fog. The data is set forth in Table 3 below:

Table 3

| Test | Fog (Veil) | Sensitivity (0.1) | Sensitivity (0.1) | Gradation |
|---|---|---|---|---|
| A | 0.45 | 7.3 | 6.0 | 3.1 |
| B | 0.46 | 7.8 | 6.5 | 3.4 |
| C | 0.40 | 8.2 | 7.0 | 4.1 |
| D | 0.30 | 9.0 | 7.8 | 4.0 |
| E | 0.30 | 9.3 | 8.2 | 4.2 |
| F | 0.30 | 9.0 | 8.0 | 5.0 |
| G | 0.35 | 8.2 | 7.2 | 4.4 |
| H | 0.35 | 7.5 | 6.5 | 5.0 |

The data set forth in Table 3 above illustrates that with the aid of the admixtures of the invention, high sensitivity is obtained and that such is obtained producing only a slight amount of fog.

EXAMPLE 4

A highly sensitive silver-iodide-bromide emulsion, product with inert gelatin, was subjected to chemical digestion with the following additions:

Test A: 6 mg. of 20% by weight solution of sodium-benzenesulfinate and dirhodanoaurate (I) complex salt, the same being employed in an amount to impart 1.6 mg. of gold pr kg. of emulsion.

Test B: same additive as Test A herein but additionally containing 4.2 mg. per kg. of emulsion of N-methyl-S-n-propylmercapto-L-cysteine, the same being employed in the form of a methanolic solution.

The emulsions were subjected to two types of exposures as follows:

a. an exposure at 1/25 second b. an exposure at 30 mins. with an appropriately low intensity.

The respective films were developed together for 5 mins. in the same developer described in Example 1 supra and an additional fog development occurred for 15 mins. The values listed in the following Table 4 illustrate the improved effect of the re-digestion admixture during long exposure with low intensity of 2 DIN (Deutsche Industrie-Norm), opposite to 1 DIN sensitivity rise during short-term exposure with high intensity.

Table 4

| Test | Exposure | Fog (15*) | Fog (5*) | Sensitivity 0.1 |
|---|---|---|---|---|
| A | a | 0.56 | 0.28 | 8.5 |
| B | a | 0.53 | 0.25 | 8.8 |
| A | b | 0.56 | 0.28 | 2.9 |
| B | b | 0.53 | 0.23 | 3.5 |

*The number indicates the exposure time in minutes

We claim:

1. A photographic emulsion comprising a silver-halide and a sensitizing amount of an asymmetrical disulfide of the formula $$(W)_a(X)_bA\text{-}S\text{-}S\text{-}B(Y)_c(Z)_d$$

wherein A and B are independently a benzyl radical or an alkyl radical containing 1 to 4 carbon atoms; X and Y are independently a carboxyl or a $C_1$ alkoxycarbonyl group; W and Z are independently amino groups which can be alkylated or acylated with a radical having 1 to 2 carbon atoms; wherein the Y and Z groups are attached to the same or different carbon atoms of the B radical, and the W and X groups are attached to the same or different carbon atoms of the A radical and *a, b, c, d* are each independently integers from 0 to 1; and the sums of $a + d$ is 1 or 2 and $b + c$ is 1.

2. A photographic emulsion according to claim 1, wherein said asymmetrical disulfide is selected from the group consisting of:

| | |
|---|---|
| $H_2N—CH_2—CH_2—S—S—CH_2—COOH$ | $H_3C—S—S—CH_2—CH(NH_2)—COOH$ |
| $i\text{-}C_3H_7—S—S—CH_2—CH(NH_2)—COOH$ | $H_5C_6—CH_2—S—S—CH_2—CH(NH_2)—COOH$ |
| $H_2N—CH_2—CH_2—S—S—CH_2—CH(NH_2)—COOH$ | $n\text{-}C_3H_7—S—S—CH_2—CH(NH_2)—COOCH_3$ |
| $n\text{-}C_3H_7—S—S—CH_2—CH(NHCH_3)—COOH$ | $n\text{-}C_3H_7—S—S—CH_2—CH(NHCOCH_3)—COOH$ |

3. A photographic emulsion according to claim 1, wherein said asymmetrical disulfide is present in the amount between $0.5 \times 10^{-5}$ and $2 \times 10^{-3}$ mol per mol of silver-halide in the emulsion.

4. A photographic emulsion according to claim 1, wherein said asymmetric disulfide is $H_2N—CH_2—CH_2—S—S—CH_2—COOH$.

5. A photographic emulsion according to claim 1, wherein said asymmetric disulfide is $H_3C—S—S—CH_2—CH(NH_2)—COOH$.

6. A photographic emulsion according to claim 1, wherein said asymmetric disulfide is $i—C_3H_7—S—S—CH_2—CH(NH_2)—COOH$.

7. A photographic emulsion according to claim 1, wherein said asymmetric disulfide is $H_5C_6—CH_2—S—S—CH_2—CH(NH_2)—COOH$.

8. A photographic emulsion according to claim 1, wherein said asymmetric disulfide is $H_2N—CH_2—CH_2—S—S—CH_2—CH(NH_2)—COOH$.

9. A photographic emulsion according to claim 1, wherein said asymmetric disulfide is $n—C_3H_7—S—S—CH_2—CH(NH_2)—COOCH_3$.

10. A photographic emulsion according to claim 1, wherein said asymmetric disulfide is $n—C_3H_7—S—S—CH_2—CH(NHCH_3)—COOH$.

11. A photographic emulsion according to claim 1, wherein said asymmetric disulfide is $n—C_3H_7—S—S—CH_2—CH(NHCOCH_3)—COOH$.

12. A photographic emulsion according to claim 1, wherein the silver-halide is silver bromide-chloride.

13. A photographic emulsion according to claim 1, wherein the silver-halide is silver-iodide-bromide.

14. A photographic emulsion according to claim 1, containing a gold sensitizer.

15. A photographic emulsion according to claim 14, wherein said gold sensitizer is a dirhodanoaurate (I) complex salt.

16. A photographic film or plate having thereon a layer of the emulsion of claim 1.

17. A photographic film or plate in accordance with claim 16 containing a gelatin binder in said layer.

18. A photographic film or plate according to claim 17 wherein the gelatin binder in said layer is an inert gelatin.

19. A photographic film or plate in accordance with claim 16 containing as the binder therefor gelatin substitutes with or without admixed gelatin in said layer.

20. A photographic emulsion according to claim 1, wherein said asymmetric disulfide is S-n-butylmercapto-L-cysteine.

* * * * *